US005440976A

United States Patent [19]

Giuliano et al.

[11] Patent Number: 5,440,976

[45] Date of Patent: Aug. 15, 1995

[54] ADJUSTABLE DISPENSING STIRRER FOR SOLUBLE SWEETENERS

[75] Inventors: Fred Giuliano, P.O. Box 47, Bellport, N.Y. 11713; John V. Mizzi, Poughkeepsie, N.Y.

[73] Assignee: Fred Giuliano, Medford, N.Y.

[21] Appl. No.: 294,542

[22] Filed: Aug. 23, 1994

[51] Int. Cl.[6] ..... B65D 25/04

[52] U.S. Cl. ..... 99/485; 99/494; 99/323; 22/365; 206/220

[58] Field of Search ..... 99/323, 287, 485, 348, 99/494; 222/365, 129, 129.3, 54; 206/219, 220

[56] References Cited

U.S. PATENT DOCUMENTS

| | | | |
|---|---|---|---|
| 2,281,267 | 4/1942 | Chapman | 30/345 |
| 2,469,589 | 5/1949 | Barricini | 99/138 |
| 3,102,465 | 9/1963 | Montesano | 99/323 |
| 3,154,418 | 10/1964 | Lovell et al. | 99/77.1 |
| 3,252,803 | 5/1966 | Belasco | 99/78 |
| 3,312,555 | 4/1967 | Rossi et al. | 99/138 |
| 3,386,837 | 6/1968 | Arnot | 99/171 |
| 3,824,322 | 7/1974 | Fiorella | 426/134 |
| 3,869,555 | 4/1975 | Henonis | 426/134 |
| 4,061,783 | 12/1977 | Hoffman et al. | 426/87 |
| 4,215,628 | 8/1980 | Dodd, Jr. | 99/323 |
| 4,387,809 | 6/1983 | Botzler | 206/526 |
| 4,816,268 | 3/1989 | Tsau | 426/85 |
| 4,849,231 | 7/1989 | Spee | 426/132 |
| 4,860,929 | 8/1989 | Lowe et al. | 222/189 |
| 4,986,991 | 1/1991 | Yatka et al. . | |
| 5,125,534 | 6/1992 | Rose et al. | 99/494 |
| 5,186,367 | 2/1993 | Hickerson | 222/365 |

FOREIGN PATENT DOCUMENTS 279758 11/1927 United Kingdom .

OTHER PUBLICATIONS

PCT, WO91/08960, Jun. 1991, PCT/BR90/00021.
Lexis database search for sweet or sugar time release.

*Primary Examiner*—David A. Scherbel
*Assistant Examiner*—Reginald L. Alexander
*Attorney, Agent, or Firm*—Alfred M. Walker

[57] ABSTRACT

A sugar stick is provided to stir coffee until a desired sweetness is attained. The dispensing device for solid granular material is user adjusted from zero to a maximum by simply adjusting a movable cover, such as a sleeve or shutter to the indicated extent for the desired amount. The stirrer includes at least one dose separator disks attached to a central portion ending in an enlarged end section to be used as a handle, which fits into a perforated tube. The product granules, e.g. an artificial or natural sweetener, which are larger in size than the perforations, are housed in the spaces between the at least one separator disk. A transparent movable outer cover, such as a sleeve, encloses the perforations and seals them from contact with the liquid beverage. By pulling the movable outer cover up, the perforations corresponding to the desired level of sweetness dose can be easily exposed. The stirrer is used to stir the beverage contents and to dissolve the desired amount of sweetener granules and the liquid beverage flows through the exposed regions of the inner perforated tube.

19 Claims, 4 Drawing Sheets

ADJUSTABLE DISPENSING STIRRER FOR SOLUBLE SWEETENERS

FIELD OF THE INVENTION

The present invention relates to an adjustable dispenser stirrer stick for sweeteners, such as sugar or artificial sweeteners. The stick incrementally dispenses a desired sweetener while the beverage, such as coffee, is stirred.

BACKGROUND OF THE INVENTION

Various devices exist for stirrer sticks which are coated at an end with sugar for stirring into coffee or tea. However, such devices do not include a means for dispensing an incremental unit dosage of a sweetener.

U.S. Pat. Nos. 4,061,783, of Hoffman, 3,312,555, of Rossi, 3,252,803, of Belascio, and 3,869,555, of Henonis, each describe a stirrer stick having a sugar or other flavor enhancer attached to the stick, wherein the sugar melts in the drink.

U.S. Pat. No. 3,824,322, of Fiorella discloses a hollow flavored stirrer for alcoholic beverages. U.S. Pat. No. 4,849,231, of Spee describes a stirrer which has a holder portion to hold a sugar lump for mixing in a drink.

U.S. Pat. Nos. 3,154,418, of Lovell and 3,386,837, of Arnot describe spoons with flavoring attached to the bowl portions of the spoons. U.S. Pat. Nos. 2,469,589, of Barricini and 2,281,267, of Chapman as well as British patent No. 279,758, of Landsberg describe eating utensils with coated confectionary.

U.S. Pat. No. 4,986,991, of Yatka describes a chewing gum with time release sweeteners, where the time release occurs due to the reaction of the components of the sweeteners.

U.S. Pat. No. 4,387,809, of Botzler and U.S. Pat. No. 4,860,929, of Lowe both disclose hollow dispensing stirrer straws.

U.S. Pat. No. 4,816,268, of Tsau also discloses a process for preparing a hollow containing stirrer straw and product thereof.

The distinguishing features from the prior art of Botzler '809, Tsau '268 and Lowe '929, do not have separator means for compartmentalizing the granulated material into small doses and, nor do they have valve means interacting with these baffle plates or separators, such as sleeves or flat shutters acting as valves to allow the beverage to interact with only exposed portions of a sweetener.

Tsau '268 is primarily involved with a process for preparing a comestible contained in a stirrer straw. The device for dispensing the product does not permit the user to adjust the product dose.

While the Boltzer '809 invention relates itself to a multi comparable combination package and stirrer device, the utilization sealing tabs, which the user removes to pour the contents into a beverage, there is no apparatus as in the present invention to permit precise user selection of dose amount of one or more additives.

Lowe '929 describes a perforated hollow tube for dispensing soluble granulated material with attention to limiting fluid leakage from the tube after use. There is no means for user adjustment of dose.

U.S. Pat. No. 3,102,465, of Montesano includes a canister for condiments, Such as tea leaves with an outer perforated dispenser which does not provide a seal; it delivers tea leaves by gravity delivery.

In Montesano '465, there are no barrier separators or inner structural plates inside, to give someone an ability to determine how much quantity of condiments to disperse. Montesano '465 does not set a precise method of delivery unit dosages of a sweetener, such as sugar, within a beverage. None of the prior art patents use barrier plates to adjust dosage in increments.

Montesano '465 is concerned with liquid dripping out of applicator. A telescoping exterior is provided to close up the canister between uses, not to expose a predetermined dosage unit. It does not have barriers between those usable deliverable units and those isolated for future use.

Furthermore, many types of controlled-release dosage forms have been devised for the drug industry. These are designed to release drug substances slowly for prolonged action in the body.

For example, coated beads or granulates are used. A solution of the drug substance in a non-aqueous solvent (e.g. alcohol) is coated Onto small inert granules or beads which may be composed of sugar and starch. Some of the beads are left uncoated to provide an immediate drug release. Coats of liquid material, such as beeswax or a cellulosic material, e.g. ethylcellulose, are applied to the remainder of the granules with some receiving few coats and some receiving many. The various coating thicknesses produce a sustained-release effect.

Microencapsulation is a process by which solids, liquids, or even gasses are encapsulated into microscopic particles by formation of thin coatings of a "wall" material around the substance to be encapsulated. Coacervation is the most common method. It involves the use of hydrophilic substances which act as the coating material. These may be natural or synthetic polymers, including shellacs, waxes, gelatin, starches, cellulose, acetate phthalate, and others. Wall thickness from 1–200 um determines the delay in releasing the drug.

Matrix devices make use of insoluble plastics or hydrophilic polymers. Generally the method of preparation involves mixing the drug with the matrix material followed by compression of the material into tablets. The primary dose to be released immediately is placed on the tablet as a layer or coat; the remainder of the dose is released slowly from the matrix.

As noted above, in a sweetener release in a chewing gum, Yatka '991 does not use drug type time-release mechanisms but instead reverts to mixtures of different sweeteners which achieve the desired dose/time relationship naturally.

The coating materials used in the drug techniques are in appropriate for beverage sweeteners, since they may have adverse effects when used in beverage sweetening applications. For example, the lipid formulations may form an unsightly "oil slick" floating on top of a cup of coffee or tea. They may also adversely affect taste; which is not a problem for the drug delivery application.

Finally, there is the question of applicability any "time-release" technique, by definition, will increase the time it takes for the sweetener to dissolve. This is not good for beverage sweeteners. For example, to provide a stick which provides a "uniformity of sweetness per stir revolution", the consumersend-user would have to be educated to expect this result. Furthermore, it is almost impossible to achieve this result anyway. The rate of solubility of sweeteners as well as time release coatings is time dependent as well as temperature dependent. Other factors that may affect these rates are pH and degree of agitation, such as diffusion vs. turbulent convective flow, Reynolds number, etc. The human factor is another problem, such as the desirability for a stir slow, or fast or medium. This determines the time to dissolve. By linking the stirring activity to desired sweetness, the other use of a stirring stick, to stir the contents of the beverage is compromised. To uniformly mix cream and coffee may result in too sweet a beverage.

In general, the prior art reviewed reveals a wide variety of approaches to stirring sticks which introduce flavoring agents to liquid beverages. Some use solid masses of agents while others are designed to dispense granular sweeteners or flavorants. In some patents the need to control the amount of sweetener added to the beverage is addressed in a crude manner. Heonis '555 has two solid masses; the bottom one can be broken off and discarded. Hoffman '783 talks about artificial sweetener in discrete spots on the stick wherein each spot or segment is equivalent to a spoon unit of sugar. The user is expected to suspend the stirrer at the correct level while stirring to control the amount of Sweetener permitted to dissolve, as this can compromise the effectiveness of the stirring. Arnot '837 teaches a cover that comes off in hot water so that the automatic opening of the package permits hygienic preparation of the beverage by a consumer with dirty hands. Several of the patents combine multiple ingredients in the same stirrer, as in Botzler '809.

OBJECTS OF THE INVENTION

It therefore is an object of the present invention to provide a beverage stirrer with a dispenser for incremental units of sweetener, for markets such as airlines, vending machines, and perhaps some fast food establishments which may be equally concerned about convenience or minimization of customer contact time.

There is therefore along felt need for sugar dispensers which share the common features of adjustable sweetness control, true "zero" control, which work as a simple stirrer, and hygienic use even by users with dirty hands.

Another object which is important for some of the artificial sweeteners is the ability to set true "sugar equivalents" as a function of concentration. The actual sugar equivalent is based on human subjects involved in "sensory panel testing". In fact, the type of beverage even has a bearing on the results. It has been found that the "sweetness ratio" of an artificial sweetener varies with concentration starting at a very high level (e.g. 300 for saccharin) at low concentrations with substantial leveling off as concentrations increase to the 7 to 8% sucrose solution equivalent.

A further object of the present invention is to provide a quick and convenient method of mixing a premeasured quantity of a solid material with a liquid, such as where a pharmaceutical material is required to be prepared fresh in order for it to be effective. In such a case the bringing together of solid and liquid components immediately before use is necessary, and the present invention provides a device for convenient accurate, and fresh pharmaceutical preparation where shelf-life is nonexistent due to the rapid deterioration nature of the material being prepared.

A further object of the present invention is to provide a device for the quick and convenient preparation of standard solutions and mixtures in general laboratory or manufacturing situations.

It is also an object of the present invention to improve over the disadvantages of the prior art.

SUMMARY OF THE INVENTION

In keeping with these objects and others which may become apparent, the present invention includes an adjustable dispensing device for granular materials, which granular materials may be soluble in the liquid medium.

The dispensing device for solid granular material can be user adjusted from zero to a maximum by simply adjusting a slidably movable cover, such as at least one sheath, sleeve or shutter to the indicated extent for the desired amount.

While a variety of thermoplastics can be used for these devices, those that can be easily recycled, such as HDPE, PE, or polypropylene may be preferably used. Alternatively, biodegradable starch-based resins such as those available from Asoke International can be used to environmental advantage.

The present invention includes three separate parts. One part includes a number of dose separator disks or separator plates attached to a central shaft or central spine ending in an enlarged end section to be used as a handle, which fits into a perforated tube or perforated envelope-like cover. The product granules, e.g. an artificial or natural sweetener, which may be larger in size than the perforations, are housed in the spaces between the separator disks. A slidably movable transparent outer cover, such as at least one sleeve or sheath encloses the perforations and seals them from contact with the liquid beverage. By using the thumb and forefinger of one hand on the convolutions or other conventional finger friction means of the slidable outer cover, such as a sealing sleeve and pulling the cover up, the perforations corresponding to the desired level of sweetness dose can be easily exposed. The stirrer is used to stir the beverage contents and to dissolve the desired amount of sweetener granules. The liquid beverage flows through the exposed regions of the inner perforated tube.

DETAILED DESCRIPTION OF THE PREFERRED EMBODIMENT

Figure 1:
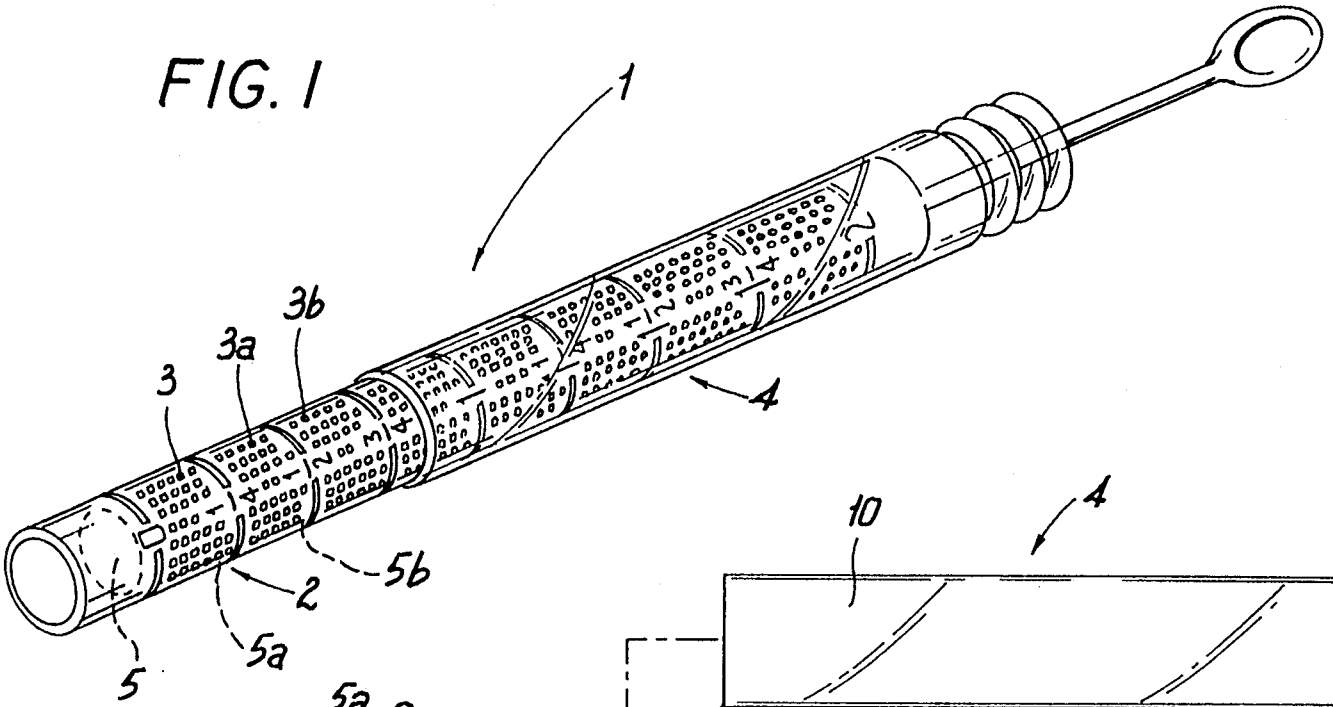
FIG. 1 is a perspective view of the sweetener stirrer stick of the present invention.
Figure 2:
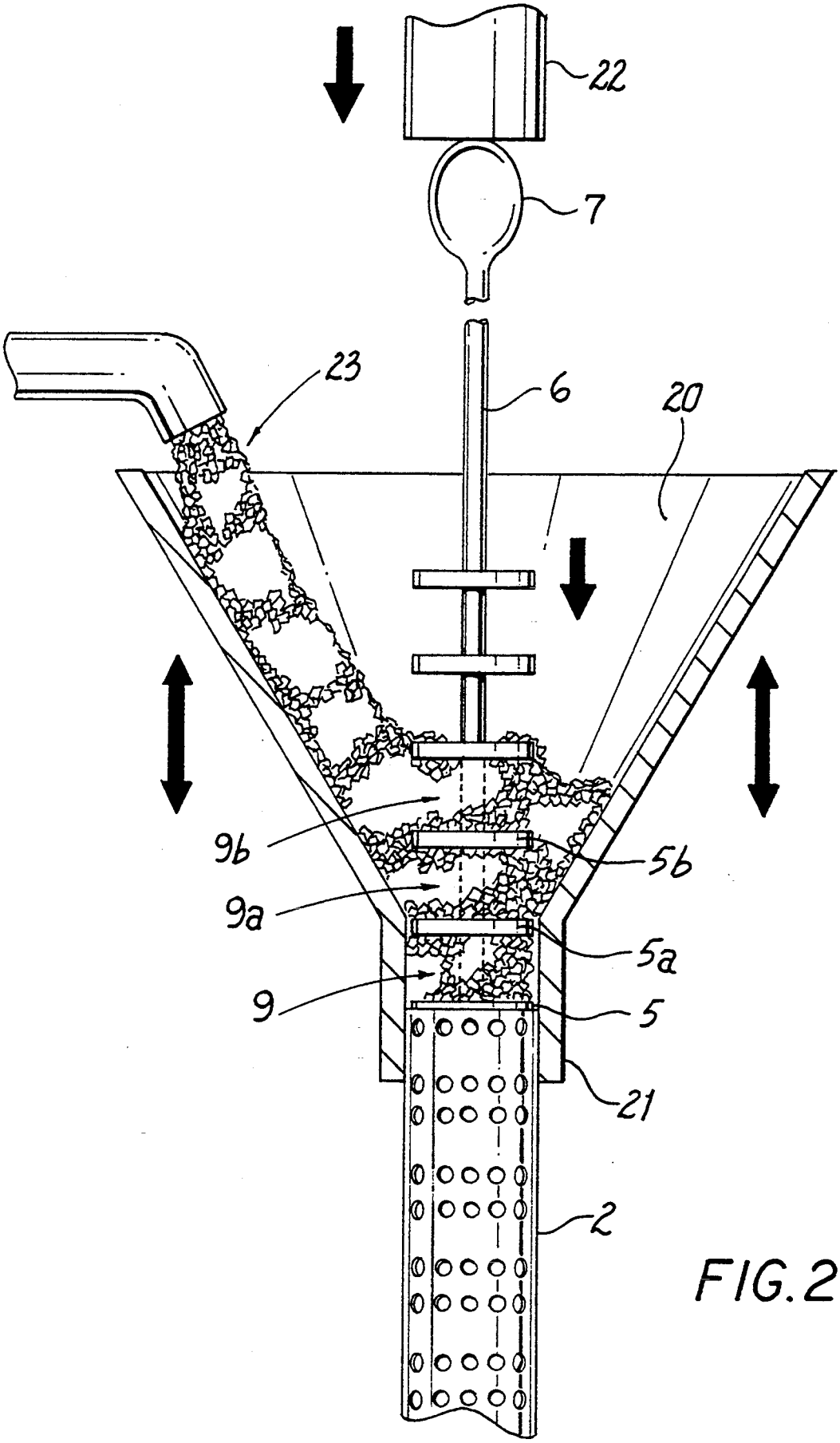
FIG. 2 is a side elevational view in cross section of a filler for the sweetener Stirrer stick as in FIG. 1.

As shown in FIGS. 1–2, the present invention is an adjustable sweetener dispensing stirrer stick 1 for soluble granular materials.

The dispensing stirrer stick 1 includes at least one perforated container compartment 2 with perforations 3 for a solid granular material is user adjusted from zero to a maximum with an adjustable cover 4, such as a sleeve or shutter, to the indicated extent for the desired amount of dispensed sweetener, such as sugar.

Although other configurations may be used, in the embodiment shown in FIGS. 1–2, perforated container compartment 2 may be tubular, and adjustable cover 4 may be a cylindrical cover sheath slidably movable over perforated container compartment 2.

The adjustable sweetener dispensing stirrer stick 1 is preferably made from thermoplastics, such as recyclable HDPE, PE, or polypropylene. Alternatively, biodegradable starch-based resins may be used in the construction of sweetener dispenser stirrer stick 1.

In the version shown in FIG. 1, stirrer stick 1 includes three separate parts assembled as shown in the exploded view and the assembled view. One perforated dispensing container part 2 includes at least one separator disk, such as a number of dose separator disks 5, 5*a*, 5*b*, etc. attached to a container portion such as shaft 6 ending in an enlarged end section 7 to be used as a handle. Perforated dispensing container part 2 fits into a tight fitting perforated tube 7 having an unperforated end piece 8.

The product granulates, e.g. an artificial or natural sweetener, which are generally larger in size than perforations 3, 3*a*, 3*b*, etc., are housed in this subassembly in at least one zone, such as zone spaces 9, 9*a*, 9*b*, etc. between the at least one separator disks 5, 5*a*, 5*b*, etc. Finally, transparent slidably outer cover 4, including outer movable sealing sheath 10, and convoluted grabbing handle portion 11, is slipped over perforated tube 2 totally enclosing the perforations 3 and sealing perforations 3 from contact with a liquid beverage within a drinking container, such as a cup.

When perforations 3 are closed by movable outer cover 4, such as a sealing sleeve, sweetener stick 1 can be used as a simple stirrer which does not add sweetener to the beverage, in a closed position. By using the thumb and forefinger of one hand on the convolutions 11 of the movable outer sealing cover 4 and pulling sealing cover 4 up, perforations 3 corresponding to the desired level of sweetness dose can be easily exposed, by adjusting the edge of outer sealing cover 4 over the desired markings 12, 12*a*, 12*b*, etc. on the perforated tube.

Stirrer stick 1 stirs the beverage contents and dissolves the desired amount of sweetener granules. Overstirring is permissible as movable outer sealing cover 4 seals unused upper perforations 13, 13*a*, 13*b*, etc. and keeps the granules therein from dissolving. Perforations 3, 3*a*, 3*b* . . . 13, 13*a*, 13*b* are placed around 360 degrees in zone spaces 9, 9*a*, 9*b*, etc. between separator disks 5, 5*a*, 5*b*, etc.. The liquid beverage can easily flow through the exposed regions of inner perforated tube 2. The sweetener granules may be formulated to dissolve as quickly as possible for convenience.

As shown in FIG. 1, separator disks 5, 5*a*, 5*b*, etc. are not spaced uniformly (d2 is larger than d1), even though each compartment is labeled to add ¼ teaspoon of sweetener "sugar equivalent". This is to compensate for the "leveling off" characteristics of the sweetness ratio as the concentration increases. This is empirically determined at the design stage for a particular beverage, sweetener, and average cup size.

Figure 1A:
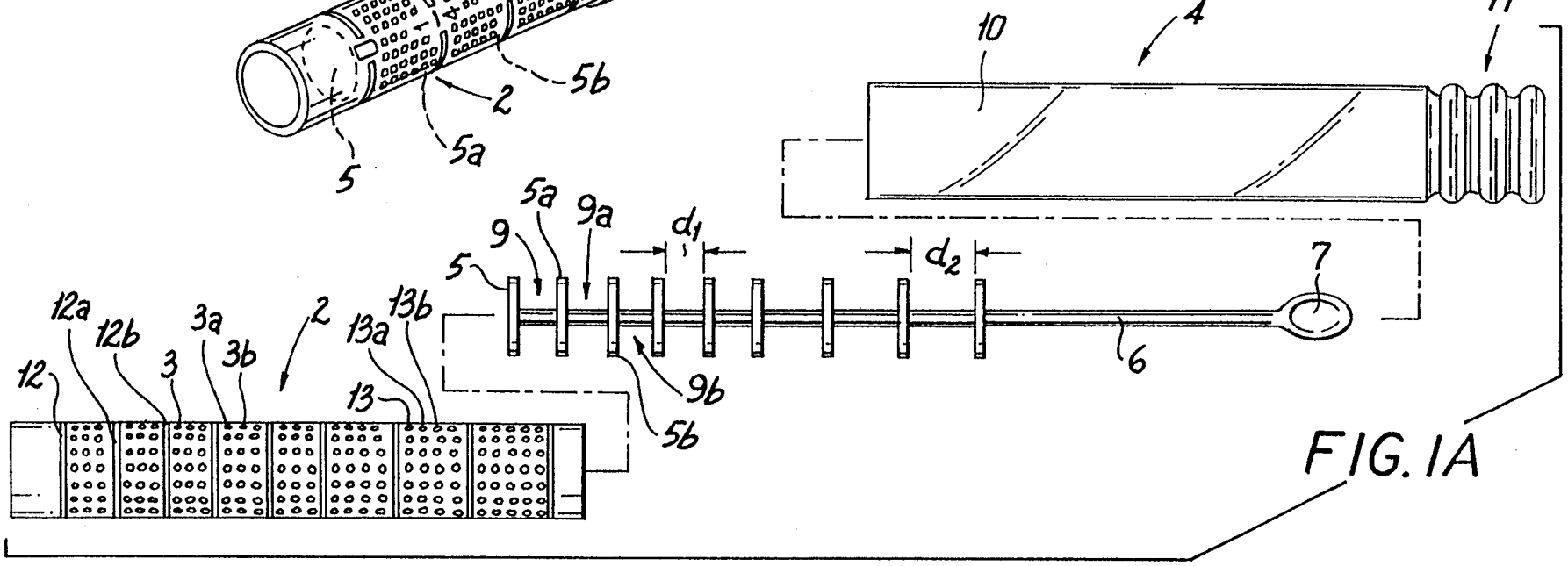
FIG. 1A is an exploded side elevational view of the sweetener stirrer stick as in FIG. 1.

Moreover, the filling method for sweetener stick 1 as shown in FIGS. 1–1A is novel. As shown in FIG. 2, an industrial filling method uses a vibratory hopper 20 which holds perforated tube 2 at its bottom 21. Tube 2 is inserted empty and is removed full from bottom 21 of hopper 20. Separator/handle 6 is started into perforated tube 2, then a ram 22 moves it down perforated tube 2 at the proper rate such that the vibrating granulates 23 fill zone spaces 9, 9*a*, 9*b* between separator plates 5, 5*a*, 5*b*. At the end of the process, a subassembly consisting of separator/handle 6 inside perforated tube 2 with the granules 23 enclosed is complete. The finished sweetener or dispenser stick 1 then requires outer sealing sleeve 4 to be slipped over perforated tube 2.

Figure 3:
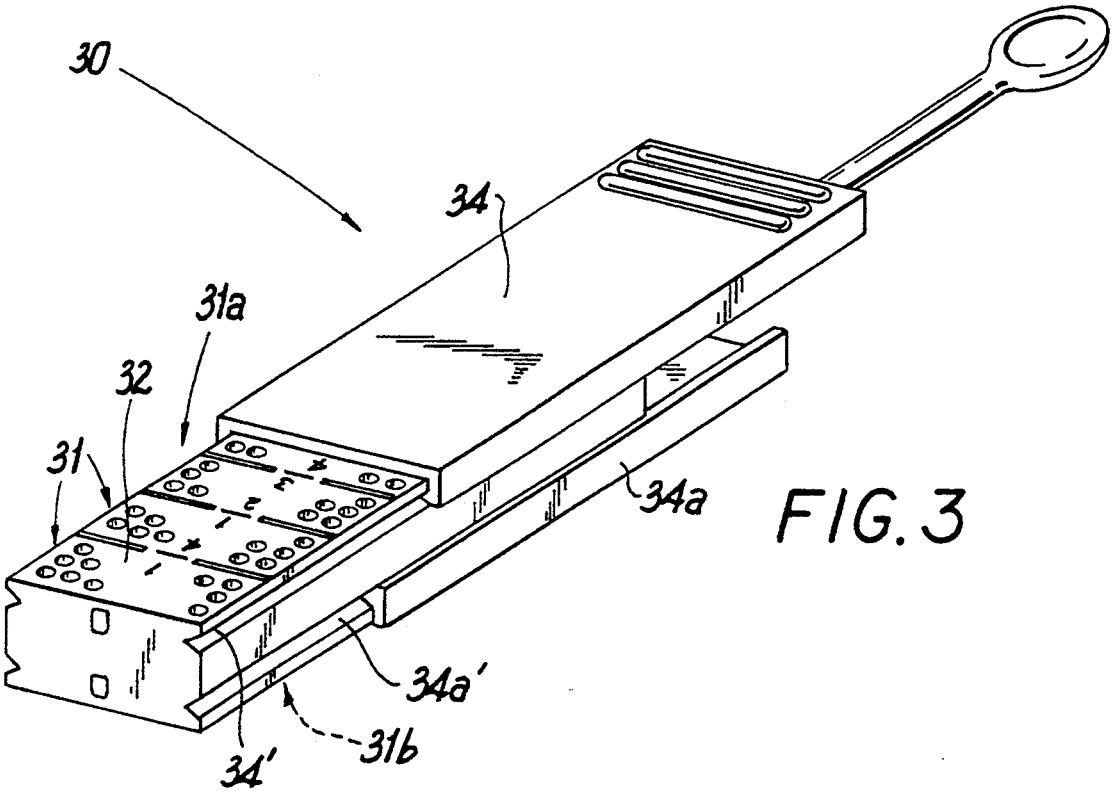
FIG. 3 is a perspective view of another embodiment for a sweetener stirrer stick.
Figure 3A:
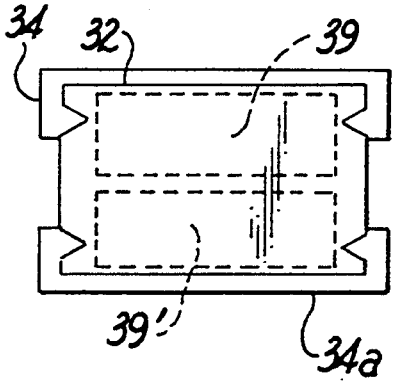
FIG. 3A is an end view in cross section of the sweetener stirrer stick as in FIG. 3.
Figure 3B:
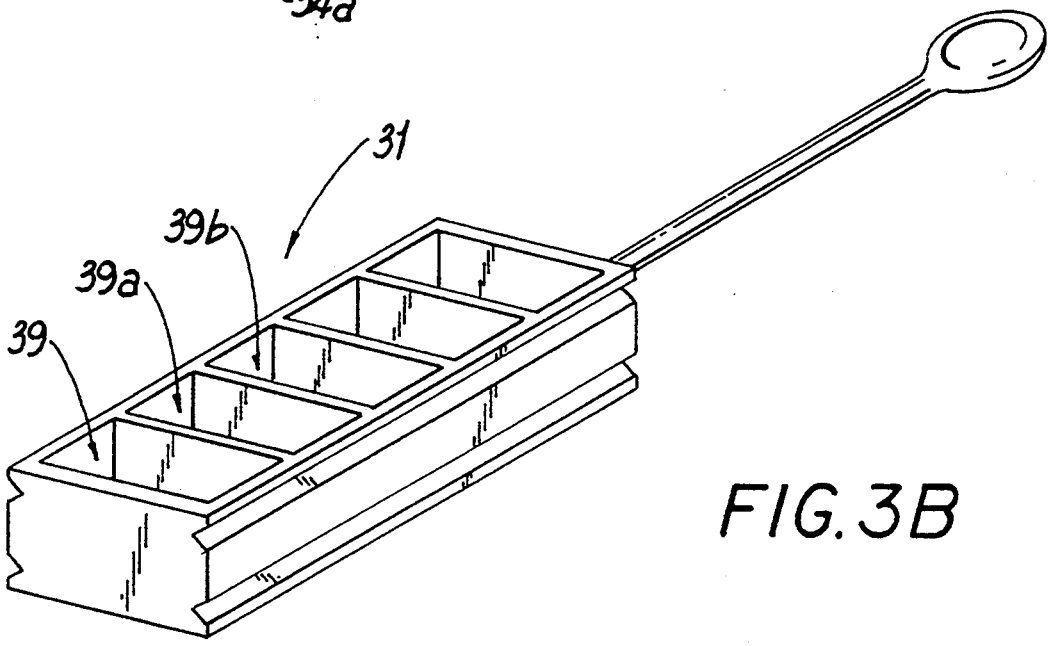
FIG. 3B is a perspective view of interior compartment of the device as in FIG. 3.

FIG. 3 shows another embodiment including a dual compartment dispenser 30. A universal sweetener stick which has the ability to dispense either a range of amount of sugar as well as artificial sweetener such as aspartame, as desired by the user, can be fabricated this way.

Alternatively, a sweetener and a non-dairy granulated creamer can be contained in such a dual compartment dispenser. For example, perforated container compartments 31 may be made from a molded one-piece compartment part 31, which has product cavities 39, 39*a*, 39*b* and 39', on two opposing faces 31*a*, 31*b* with dose compartments or separators. Once one side 31*a* is filled and leveled off, a perforated layer 32 is attached to seal the granules in. At least one slidably movable cover, such as at least one slidably movable sealing shutter 34, which can either be a section of extrusion or a molded piece, rides in grooves 34' on the side of the first part 31*a* and can seal or expose the desired perforated areas 39 to select the dose. The same is done with the opposing face 31*b* wherein a further movable sealing shutter 34*a* rides in grooves 34*a'* to enclose lower cavities 39' containing granules therein. The volumetric capacity of the two sides need not be the same.

Figure 4:
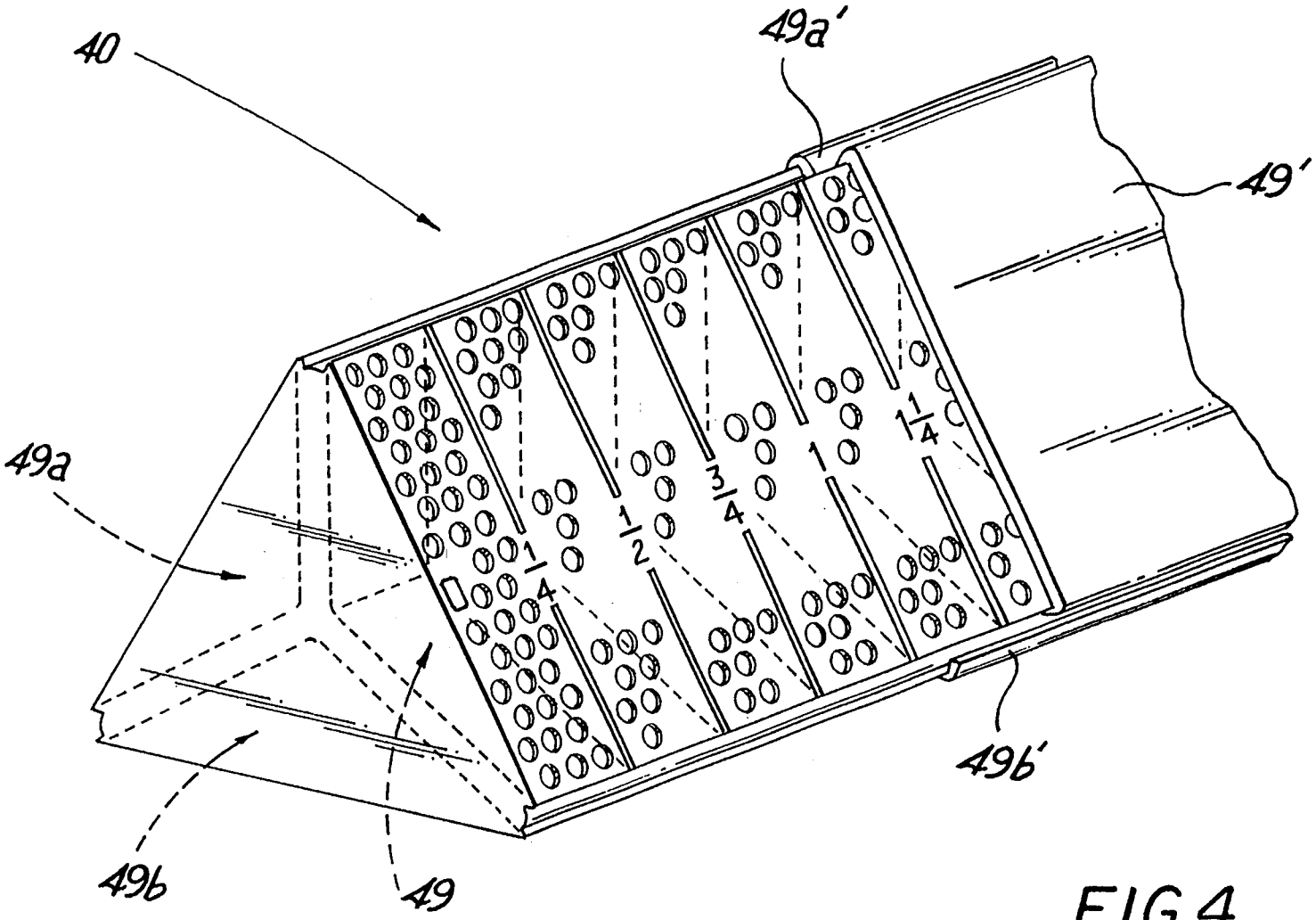
FIG. 4 is a further embodiment for a sweetener stirrer stick with a three sided compartment dispenser.

FIG. 4 shows yet another embodiment showing a triangular cross section dispenser 40 with the ability to dispense desired amounts of three separate soluble granulated items. For example, three dispensing compartments 49, 49*a*, 49*b* can be devoted to sweetener, creamer, and lemon flavored granules creating a "Coffee/Tea Universal Stick". Each compartment 49, 49*a*, 49*b* is covered by slidably movable shutters 49', 49*a'*, 49*b'*.

As can be envisioned, four, five or even more sections are possible with end cross sections being squares, pentagons, hexagons, etc. Each "face" of each container compartment can handle another choice of flavoring agent with the means of exclusion or setability of the desired amount by the user.

These more elaborate packages may have special applications such as for space missions, preparation and/or industrial manufacture of solid-liquid mixtures of all kinds where convenience and precision of the quantity of solid mixed with the liquid is important, such as, but without limitation, in chemical 1laboratories for the preparation of standard solutions; in pharmacies and hospitals for the preparation of medications where freshly mixed and carefully measured solid and liquid components are important; and generally in all kinds of situations where a carefully measured and controlled on-the-site mixing of solid and liquid components is important.

The stirrer of the present invention may also be provided with a color scheme for user identification of particular solid contents, such as a green stirrer for natural sugar sweetener and a blue stirrer for containing an artificial sweetener.

In summary, the stirrer of the present invention includes at least one perforated container with at least one compartment, which container is covered by a slidably movable cover to incrementally dispense predetermined amounts of a material, such as a sweetener for a hot beverage. The perforated container may be a perforated tube covered by a slidably movable cylindrical tubular cover. Alternatively, the perforated container may be a plurality of containers of varying geometric configurations, wherein each container is covered by a slidably movable shutter.

It is anticipated that other modifications may be made in the present invention Without departing from the scope of the invention, as noted in the appended claims.

We claim:

1. A stirrer for convenient controlled dispensing of a solid into at least one material of a liquid, comprising:

an elongated body, the stirrer having a handle end and an opposite dispenser end, a container portion extending therebetween, and wherein said elongated body further having at least one dispenser region extending along said container portion from a point beginning near or substantially at said dispenser end, and said elongated body also having a handle region, extending along said container portion from a point near or substantially at said handle end of said stirrer, said handle region comprising a stirrer handle, and further wherein said at least one dispenser region of said container portion being provided with at least one separator plate attached to said container portion, said respective separator plate further having at least one outer edge, and said stirrer further having a perforated cover, said cover being substantially coextensive with said dispenser region of said container portion and said perforated cover further being in effective sealing contact with said at least one outer edge of said respective at least one separator plate, and further, said container portion, said separator plate and said perforated cover further comprising at least one compartment for containing a solid material to be dispensed; and further wherein said stirrer further having at least one slidably movable outer cover, said outer cover being in effective sealing contact with said perforated cover, and said at least one slidably movable outer cover having a full open position and a full closed position, said slidably movable outer cover being substantially coextensive and in positional register with said perforated cover in the full closed position, and with said slidably movable outer cover slidable movable between the full closed and full open positions, said slidably movable outer cover permitting the user to adjustably select a zone position corresponding to a desired amount of a solid material to be dispensed from said container portion of said stirrer into a liquid.

2. The device of claim 1, wherein said at least one slidably movable outer cover includes a suitable means for convenient control of slidable movement and wherein said perforated cover has indicia for a user to visually determine the position of said slidably movable outer cover.

3. The device of claim 2, wherein said means for convenient control of slidable movement is a finger friction means for facilitating a user's grip on the sheath.

4. The device of claim 2, wherein said at least one compartment for containing a solid material is a plurality of compartments are of equal volume.

5. The device of claim 2, wherein said at least one compartment for containing a solid material is a plurality of compartments are of unequal volume.

6. The device of claim 5, wherein the volume of each of said compartments is least at said dispenser end of said stirrer and said compartment volumes successively increase as said compartments are situated successively further from said dispenser end of said stirrer.

7. The device of claim 5, wherein said volume of said compartments is greatest at said dispenser end of said stirrer and said compartment volumes successively decrease as said compartments are situated successively further from said dispenser end of said stirrer.

8. The device of claim 2, wherein said elongated body is an elongated substantially cylindrical body and further wherein said perforated outer cover is a substantially cylindrical shape, and said at least one outer cover is a cylindrical sheath.

9. The device of claim 2, wherein said body comprises a plurality of central portions in a substantially triangular cross sectional shape and further wherein said at least one perforated cover comprises a plurality of perforated covers, said central portion having a substantially triangular cross sectional shape, and said at least one outer cover further comprises a plurality of shutters.

10. The device of claim 2, wherein said body comprises a substantially flattened rectangular cross sectional shape and further wherein said at least one perforated circumferential cover comprises a substantially flattened rectangular cross sectional shape, and said at least one movable outer cover further comprises at least one shutter having a substantially flattened rectangular cross sectional shape.

11. The device of claim 2, wherein said body comprises an a substantially square cross sectional shape and further wherein said perforated cover, comprises a substantially square cross sectional shape, and said movable outer cover comprises at least one telescoping sheath having a substantially square cross sectional shape.

12. The device of claim 2, wherein said body comprises an a substantially polygomal cross sectional shape and further wherein said perforated cover, comprises a substantially polygonal cross sectional shape, and said movable outer cover comprises at least one telescoping sheath having a substantially polygonal cross sectional shape.

13. The stirrer as in claim 1 wherein said at least one material is a sweetener.

14. The sweetener as in claim 13, wherein said sweetener is sugar.

15. The sweetener as in claim 13, wherein said sweetener is aspartame.

16. The stirrer as in claim 1, wherein said at least one material is a solid.

17. The stirrer as in claim 1, wherein said at least one material is a liquid.

18. A stirrer for convenient controlled dispensing of a solid of at least one material into a liquid, comprising:

an elongated body, the stirrer having a handle end and an opposite dispenser end, a container portion extending therebetween, and wherein said elongated body further having at least one dispenser region extending along said container portion from a point beginning near or substantially at said dispenser end, and said elongated body also having a handle region, extending along said container portion from a point near or substantially at said handle end of said stirrer, said handle region comprising a stirrer handle, and further wherein said at least one dispenser region of said container portion being provided with at least one separator plate attached to said container portion, said respective separator plate further having at least one outer edge, and said stirrer further having at least one slidably movable outer cover, said at least one slidably movable outer cover having a full open position and a full closed position, said slidably movable outer cover being substantially coextensive and in positional register with said dispenser region in the full closed position, and with said slidably movable outer cover slidable movable between the full closed and full open positions, said slidably movable outer cover permitting the user to adjustably select a zone position corresponding to a desired amount of a solid material to be dispensed from said container portion of said stirrer into a liquid.

19. The device of claim 18, wherein said at least one slidably movable outer cover includes a suitable means for convenient control of slidable movement and wherein said dispenser has indicia for a user to visually determine the position of said slidably movable outer cover.

* * * * *